US006431077B1

(12) United States Patent
Hijlkema

(10) Patent No.: US 6,431,077 B1
(45) Date of Patent: Aug. 13, 2002

(54) TRAIN

(75) Inventor: Bernardus L. L. Hijlkema, Leeuwarden (NL)

(73) Assignee: Ingenieurs Bureau Oranjewoud B.V. (NL)

( * ) Notice: Subject to any disclaimer, the term of this patent is extended or adjusted under 35 U.S.C. 154(b) by 0 days.

(21) Appl. No.: 09/509,219

(22) PCT Filed: Sep. 22, 1998

(86) PCT No.: PCT/NL98/00547

§ 371 (c)(1),
(2), (4) Date: May 24, 2000

(87) PCT Pub. No.: WO99/15386

PCT Pub. Date: Apr. 1, 1999

(30) Foreign Application Priority Data

Sep. 24, 1997 (NL) ..... 1007109

(51) Int. Cl.[7] ..... B60V 3/04
(52) U.S. Cl. ..... 104/23.1; 104/23.2
(58) Field of Search ..... 104/23.1, 23.2, 104/154, 134

(56) References Cited

U.S. PATENT DOCUMENTS 425,408 A * 4/1890 Craw ..... 104/154
465,151 A * 12/1891 Barre ..... 104/134
799,950 A * 9/1905 Theryc ..... 104/134
3,233,556 A * 2/1966 McDonald ..... 104/136
3,935,819 A * 2/1976 Klein ..... 104/23
3,938,445 A * 2/1976 Hughes ..... 104/124
4,804,305 A * 2/1989 Lapotaire ..... 414/233

FOREIGN PATENT DOCUMENTS

DE 46847 C 5/1889
DE 2603633 A 8/1997
GB 5569 10/1909

* cited by examiner

*Primary Examiner*—Joseph D. Pape
*Assistant Examiner*—Greg Blankenship
(74) *Attorney, Agent, or Firm*—Mark Zovko

(57) ABSTRACT

The invention relates to a train (1) which forms a transport device displaceable along a fixed track (3), comprising a frame with a drive; at least one bogie (6) with a flat sole (10); and at least one supply of a liquid which is suitable for pouring the liquid over the track (3), wherein at speed of the train higher than a threshold value at least a part of the sole (10) floats over a film created by liquid. The supply is adapted to carry the liquid onto the track (3) in front of the sole (10) in the direction of movement of the train (1) and the sole (10) is positioned inclining upward on the front side in the direction of movement. The invention also relates to a track (3) for an above described train (1) which comprises at least one platform extending in horizontal direction. The platform is coated with a levelling material, wherein an upper surface of the track has a very high degree of smoothness with very small height differences.

8 Claims, 5 Drawing Sheets

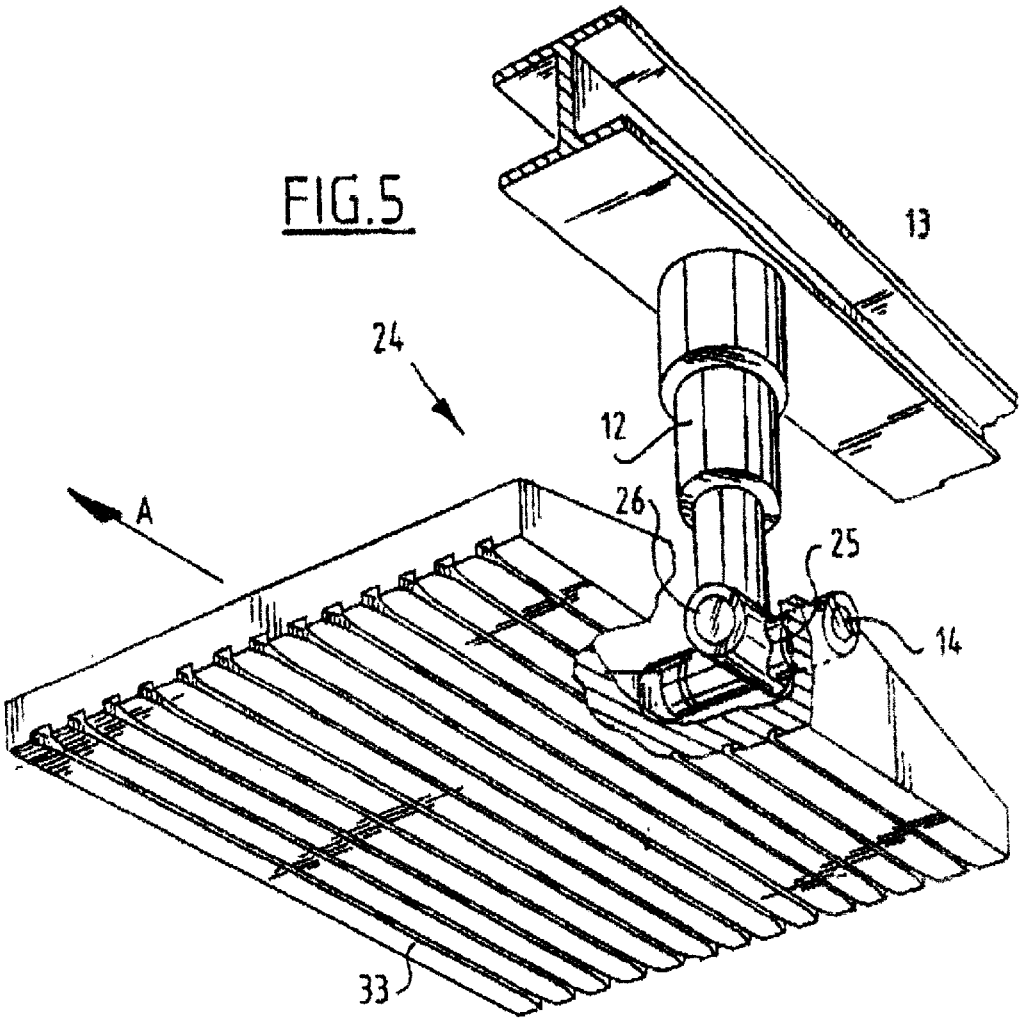
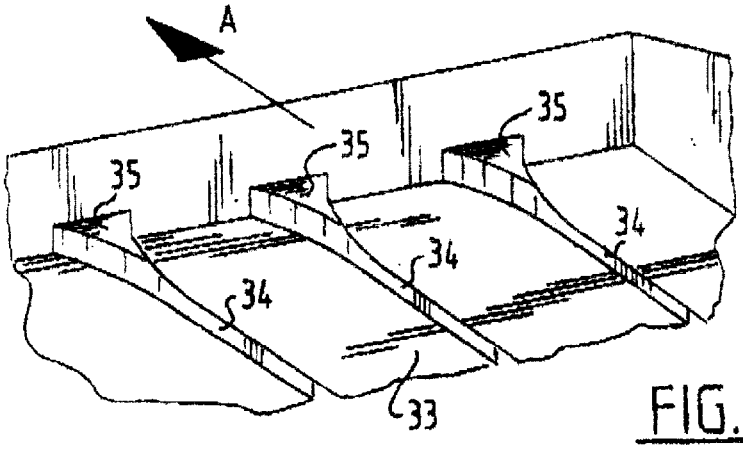
FIG.6

TRAIN

The present invention relates to a train which forms a transport device displaceable along a fixed track, comprising:

a frame with a drive;

at least one bogie with a flat sole; and at least one supply of a liquid which is suitable for pouring the liquid over the track, wherein at a speed of the train higher than a threshold value at least a part of the sole floats over a film created by the liquid.

Such a train is known from the British patent specification 5.569 in which such a configuration of a train is described, wherein transport is made possible particularly as a result of the upward force of the liquid which is generated by a compressor and which is directed under the sole to discharge the liquid under pressure here via the supply.

According to the prior art the pressure to be generated by this compressor must be maintained even when an aquaplaning effect occurs above a determined speed, wherein a part of the bottom surface of the sole floats over a water film. A drawback associated herewith is that a heavy compressor is required, wherein as a result of the configuration of the prior art, too much water or another liquid is lost precisely as a consequence of the high pressure to enable transport over a distance which is usual in practice.

A further drawback is that the supply debouches under the sole. At a high speed there is the danger here that the part of the surface of the sole located at the front in the direction of movement of the train is deprived of water or other liquid, which does not reach this front part of the surface of the sole, precisely as a result of this high speed and thereby insufficient pressure. In this situation that part of the surface of the sole deprived of liquid will come into contact with the surface of the track because no liquid film lies therebetween. In this situation the train will travel in a jolting manner until the speed is sufficiently reduced and the liquid under pressure can once again reach the front part of the surface of the sole on the track. The damage which can hereby be caused to track and sole is considerable.

The invention has for its object to obviate at least one of the above stated problems and a train is provided for this purpose which is distinguished in that the supply is adapted to carry the liquid onto the track in front of the sole in the direction of movement of the train, and that the sole is positioned inclining upward on the front side in the direction of movement.

In this manner is ensured that at any speed above the threshold value the entire sole is involved in the aquaplaning effect, wherein the entire sole slides above the track, floating on the liquid film. Further achieved, in combination with the form of the track, is that only a very small quantity of liquid is required to realize the liquid film, wherein this liquid moreover does not have to be delivered at high pressure under the sole but, on the contrary, can simply be deposited on the track practically without pressure. As already stated above, small quantities of liquid can herein suffice to bring about the intended effect. The track can moreover be cleaned during application of the liquid, which is herein sprayed over the track under some pressure. The sole is further positioned inclining upward at the front in order to bring the largest possible quantity of liquid under the sole, wherein a progressively smaller space or volume in rearward direction is available, so that an equilibrium results between the force of the water on the sole and vice versa.

In a first embodiment a train according to the present invention has the property that the bogie is arranged for free tilting on the train at least in the direction of movement thereof, wherein the tilting point of the bogie is positioned in the direction of movement behind the centre of the length of the sole and in front of the maximum of the upward pressure on the bogie generated at the higher speed by the liquid film. As a result of the ability of the sole to tilt freely, a self-adjustment of the position of the sole is effected depending on the pressure on the sole and on the speed of the train. This is the case because the total moment acting at a determined speed on the part of the sole in front of the tilting point in the direction of movement is in equilibrium with the total moment exerted on the part of the sole behind the tilting point. The front part of the sole is herein directed slightly upward, wherein the tilting point is situated just behind the centre of the length of the sole and the sole encloses a relatively thick liquid film on the front side.

In a second embodiment a train according to the present invention has the property that the sole forms a sliding surface, wherein the sliding surface preferably contains grooves lying in the direction of locomotion of the train. Thus is achieved that respectively for the sole designed as sliding surface a large support surface is provided on the water film spread on the track and that even distribution of the water film is obtained by means of the grooves. In an embodiment of the train according to the invention has the property that the grooves are designed narrowing in rearward direction relative to the direction of locomotion. More of the liquid lying on the track is hereby enclosed beneath the sliding surface and pressed out of the grooves in downward direction along the length of the grooves so as to have a favourable influence on the upward force generated by the water film.

In a third embodiment of the present invention a train according to the present invention has the property that at least one supplementary supply of additional liquid is arranged in the bogie and debouches under the sole. In this manner a per se known configuration is obtained, which is however only used or set into operation as long as the threshold value of the speed is not yet reached by the moving train. Possible losses can also be replenished using the supplementary supply, which is particularly relevant when the train is one with a number of successively arranged bogies which, in respect of the liquid film, are all dependent on a collective supply at the front part of the train in front of the leading bogie.

In a fourth embodiment a train according to the present invention has the property that at least one conduit is arranged in the bogie which debouches under the sole for supply of a fluid with a lower viscosity than the liquid. Use can herein be made of for instance gas as fluid, wherein as a result of supplying this fluid with a lower viscosity than the liquid the aquaplaning effect is better utilized, wherein the sole floats over the liquid with the fluid thereon on the track, so that the movement resistance is decreased. The fluid therefore preferably also has a lower density, so that is remains lying on the liquid, this already being ensured particularly when gas is used as fluid.

In a fifth embodiment a train according to the present invention has the property that the sole is divided into at least two areas which are enclosed by downward extending peripheries of resilient material substantially along the circumference of each of the areas. In preference each of the two areas can be separately provided herein with liquid and optionally fluid, so that control of the position of the sole in lateral direction, in the direction of locomotion of the train or both can be hereby obtained or improved, so that adjustment of this position can be optimized subject to the speed under the influence of an active control. The peripheries manufactured of resilient material are provided to minimize losses, whereby as much of the supplied liquid and the supplied fluid as possible can be used efficiently without flowing directly out of the space under the sole, whereby losses occur.

The invention otherwise also relates to a track for a train according to any of the foregoing claims which comprises at least one platform extending in horizontal direction. This track is also known from the above mentioned publication of the British patent specification 5.569, wherein this track results in considerable losses as a result of the inherent properties thereof, and particularly the deficient smoothness thereof.

A track according to the present invention is distinguished in that the platform is coated with a levelling material, wherein an upper surface of the track has a very high degree of smoothness with very small height differences. As a result of the properties of the track provided here according to the invention, losses as a result of unevenness are minimized. In order to obtain the desired smoothness or evenness use can preferably be made of ultra high molecular weight polyethylene, with which a very high degree of evenness can be realized.

In a first embodiment a track according to the present invention has the property that a guide extending in upward direction is arranged along the longitudinal axis of the track, which guide comprises engaging means on at least one side for co-action with the drive of the train. Because the guide extends along the longitudinal axis of the track, engagement for the purpose of driving takes place at least close to the centre of the track, so that a possible asymmetrical distribution of forces and pitching sideways of the train as a result thereof is prevented in effective manner.

As a possible second embodiment, the engaging means preferably comprise at least one gear rack path, wherein the drive comprises at least one toothed wheel co-acting with the gear rack path and connected to a motor. This is therefore an embodiment which is simple of realization, entails relatively low cost and which preferably comprises a two-sided central drive. Alternatively, it is possible within the scope of this embodiment that a guide extending in upward direction is arranged along the longitudinal axis of the track and that the track or the guide comprises means co-acting with a contact-free driving of the train, such as a magnetic drive. It is obvious that the drive for reaching and maintaining the speed required for aquaplaning can be realized in many ways.

In a third embodiment a track according to the present invention is characterized by at least one supply of liquid connectable to a bogie of the train. The supply of liquid has the advantage that in order to be moved the train itself does not have to be provided with a tank or similar means other than for instance an emergency tank from which liquid can be drawn in the case that the supply in the track provides no or insufficient liquid.

The same applies in a fourth embodiment of a track according to the invention which is characterized by at least one conduit of fluid connectable to a bogie of the train or by power conductors connectable to the train for transport of electrical power to the train. In the latter case the need for an overhead line is dispensed with.

The invention will be further elucidated hereinbelow with reference to an embodiment thereof. In the drawing:

FIG. 5 shows a perspective view of a detail of FIG. 1; and

FIG. 6 shows a detail of the slider shown in FIG. 5.

Corresponding components are designated in the figures with the same reference numerals.

Figure 1:
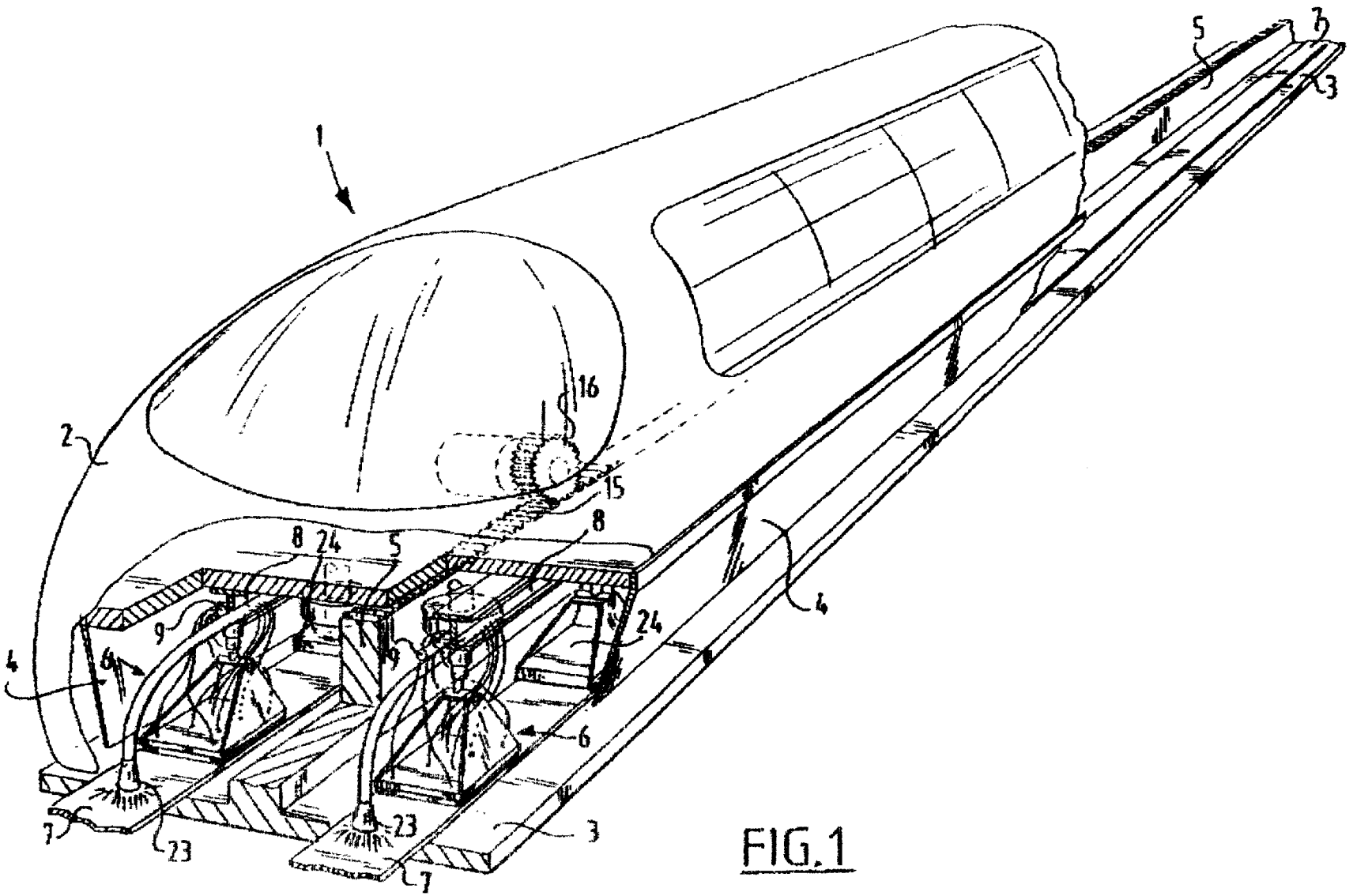
FIG. 1 shows a partly cut-away perspective view of a train and track according to the present invention.

The train 1 shown in FIG. 1 comprises a number of bogies 6 which will be further described hereinbelow, coachwork 2 and partitions 4 on the side of train 1. Train 1 travels over a track 3 which is provided for this purpose with a coating 7 at the location of bogies 6 and sliders 24, which are positioned in line in the direction of locomotion. The track further comprises a guide designed as a ridge 5 on which is arranged a gear rack path 15 which is engaged by a toothed wheel 16, which toothed wheel forms part of the drive of the train, of which a motor (not shown) such as an electric motor also forms part. Alternatively (not shown here), use can be made of for instance a magnetic drive or other type of suitable drive instead of the mechanical drive by means of the gear rack path and driven toothed wheel co-acting therewith.

In the embodiment shown here, track coating 7 is manufactured from UHMWPE, or ultra high molecular weight polyethylene, which is flexible to some extent and displays very specific and advantageous properties in respect of the smoothness to be realized therewith of the surface of track 3 over which bogies 6 move. UHMWPE moreover has the capacity to absorb dust and dirt into itself under the influence of sufficient pressure, so that these cannot have a disrupting influence on the aquaplaning effect. Track 3 otherwise has a very small downward inclination, in the order of magnitude of 1:100–1:500, laterally in both directions from the centre formed by ridge 5.

Scraping devices can be arranged as possible addition to the embodiment shown in FIG. 1. These can be designed for instance in a <> or a >< configuration at a position between spray nozzles and first bogie or slider or in front of the spray nozzles. Such a scraping device can further have a configuration with one or more than one pressure edge on the basis of the principle of a pressure collar shown for instance in FIG. 3.

Figure 2:
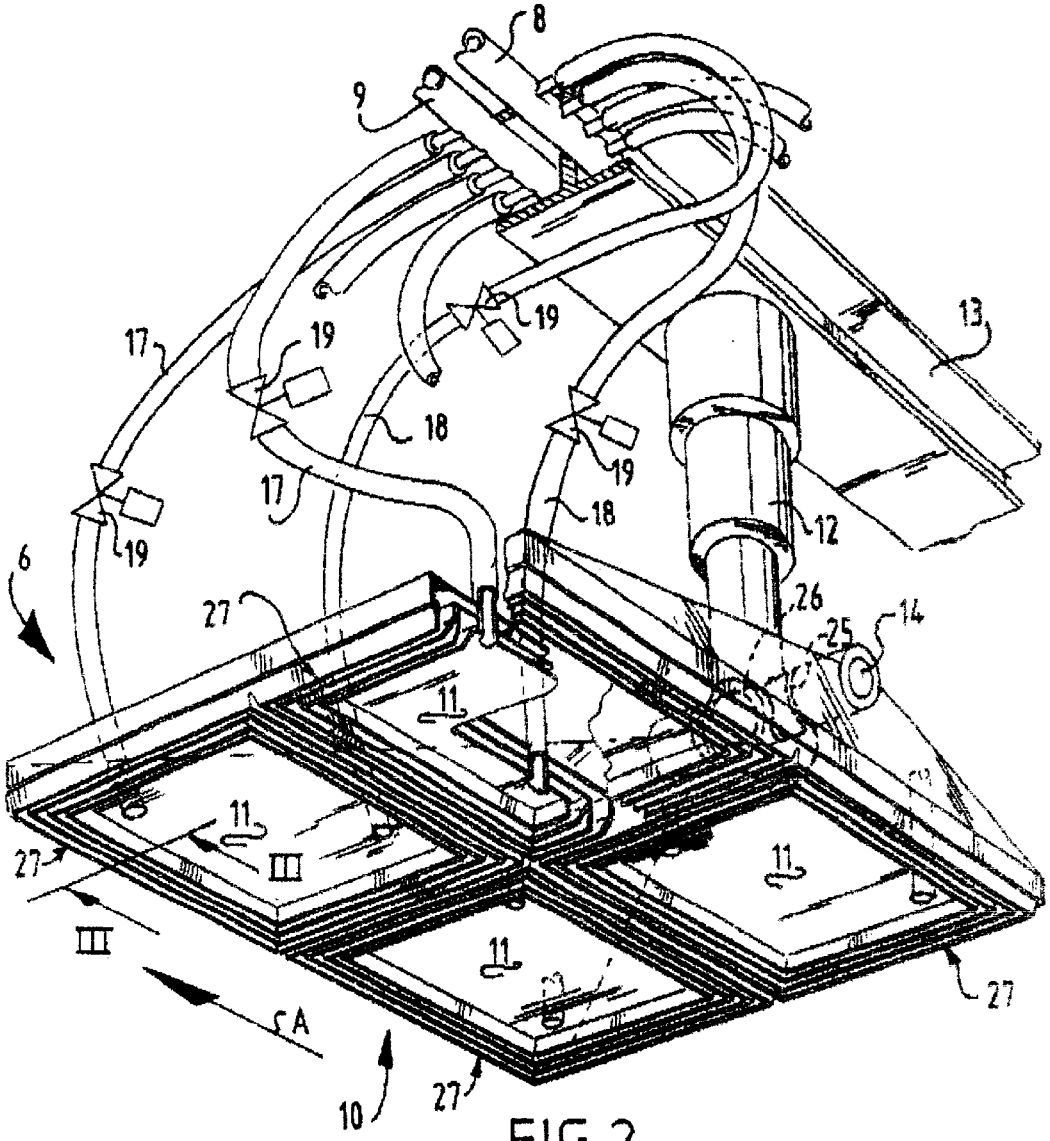
FIG. 2 shows a partly cut-away perspective view of a detail of the train shown in FIG. 1.

With reference to FIG. 2 it is noted that the bogie 6 shown here is mounted by means of a shaft 14 on a leg 12, wherein bogie 6 is tiltable up and/or downward in the travel direction of the train relative to leg 12 and therefore relative to the other parts of the train, such as profile 13, this being indicated with dotted line 25. In the embodiment shown here, bogie 6 is also tiltable in lateral direction by means of a tilting connection between shaft 14 and leg 12, whereby adapting of the position of bogie 6, and therefore of sole 10 thereof, transversely of travel direction A is possible, which results for instance in a better track-holding of the bogie when a bend must be negotiated and the track here has a certain inclination corresponding with the bend. The bogie with sole 10 thereon is therefore preferably tiltable in all directions. The sole further has dimensions of 0.5×0.5 m, which is only an example. The shape of sole 10 shown here, and therefore of bogie 6, also has alternatives within the scope of the present invention. In an embodiment (not shown) use can thus be made of a sole with a triangular shape, or a part of an ellipse, although other shapes are also possible. The same is true of sliders 24 in FIG. 1.

The leg 12 can be provided in a random known manner with a damping or suspension to prevent jolts occurring during movement of the train.

A supplementary supply of additional liquid designed as supply 8 runs though profile 13, wherein in this case the liquid is water. A conduit designed as gas supply 9 for supplying a fluid with a lower viscosity than the liquid is further also arranged in profile 13. Each water supply 8 in particular runs to an atomizing spray nozzle 23 with which dirt is sprayed from track 3 and liquid (water) is sprayed onto the track.

Water supply 8 and gas supply 9 are each connected by means of water hoses 18 and gas hoses 17 respectively to a number of sub-sectors of sole 10 designed as compartments 11. FIG. 2 shows schematically that pressure regulators 19 are arranged in water hoses 18 and gas hoses 17 to control the supply of gas and water to each of the compartments 11. It is possible for pressure regulators 19 for a number of bogies 6 to be collectively controlled so as to realize uniformity of the position of the bogies relative to the underside of train 1 and to the track 3 for these bogies 6.

In the embodiment shown in FIG. 2, the compartments are each provided with individually controllable pressure collars 27 such as will be further described with reference to FIG. 3. In an alternative embodiment (not shown) it is however equally possible within the scope of the present invention to apply a single pressure collar which encloses all the compartments 11, wherein a single separation is arranged between the compartments. A bogie 6 can also be designed such that it comprises a single compartment with a single pressure collar therearound, wherein this latter, whether or not it makes an essential contribution to the bearing capacity, serves to maintain and provide replenishment to the water film over which the sliders can then float. In the configuration of FIG. 2 it is possible to control the operation of sole 10 per compartment 11 via gas hoses 17 and water hoses 18 and also via pressure collars 27, the operation of which can be controlled per compartment 11.

During use a layer of gas will spread over the water so that, as a result of the lower viscosity and the lower "drag coefficient" or movement resistance associated herewith, a greater efficiency is obtained. If use is made not of gas but a second liquid with a lower viscosity, this second liquid must have a lower density so that it forms a layer on the layer of the first liquid. In the embodiment shown here the sole 10 is further designed as a stainless steel plate covered with a rubber layer, wherein the rubber layer, the UHMWPE layer 7 on track 3 and the water film and gas layer therebetween co-act as a result of in any case the flexibility of the rubber layer and the UHMWPE layer to bring about micro-adjustment, i.e. irregularities of small dimensions do not have any influence on the aquaplaning effect.

Figure 3:
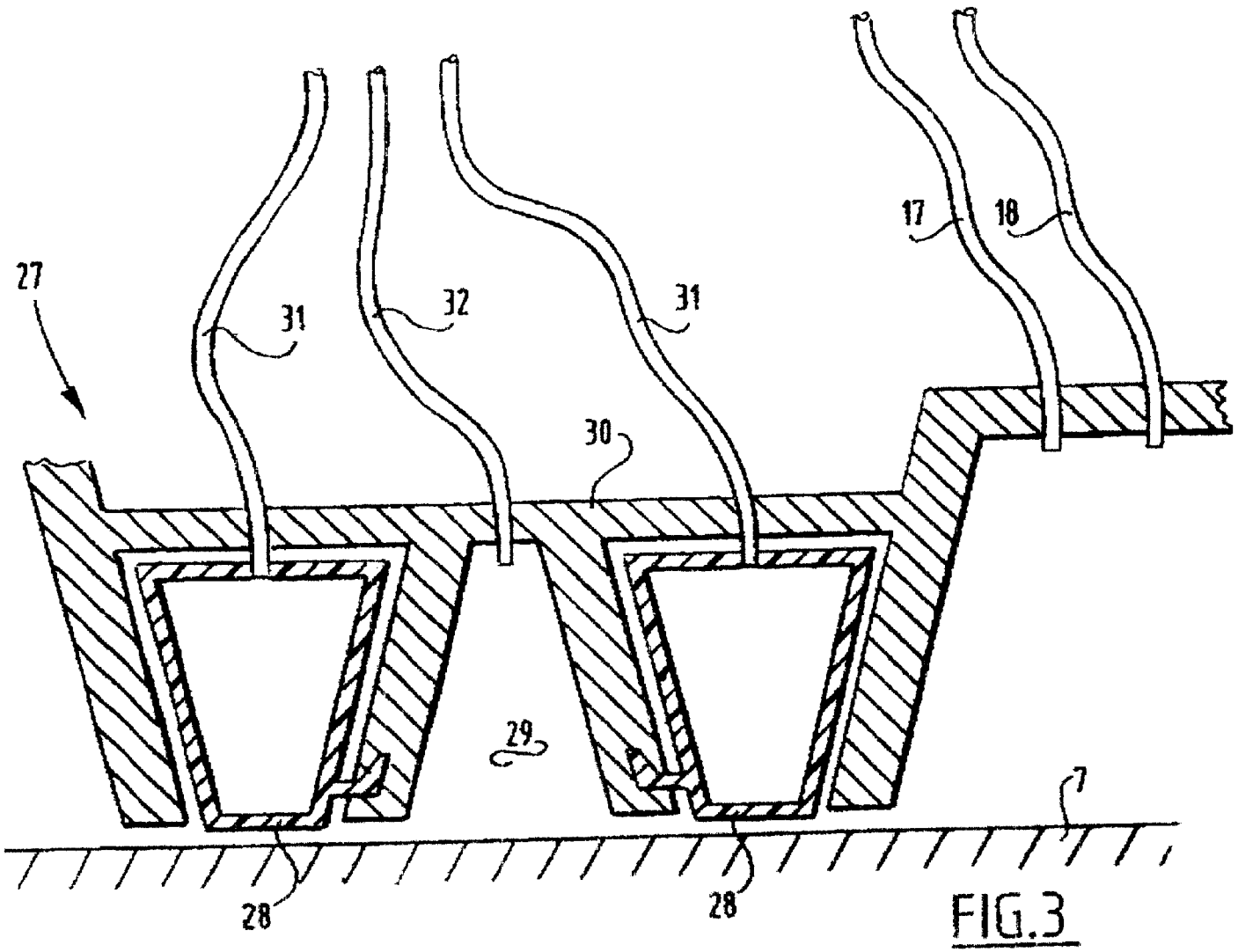
FIG. 3 shows a side-view in cross-section along a line III—III in FIG. 2 of a detail therein.

FIG. 3 is a view in cross-section of a detail of FIG. 2 designated with the line III—III of the pressure collar 27 shown therein.

Pressure collar 27 is formed here by a form-retaining profile 30 with cavities opened to the bottom. Elastically expandable bodies 28 are arranged in these cavities, wherein however the central cavity 29 is empty. Bodies 28 expand under the influence of pressure which is exerted thereon by means of conduits 31 and which can be created pneumatically or hydraulically. In the embodiment shown here, conduits 31 are suitable for supply of liquid under pressure, as is the conduit 32 leading to central cavity 29. When the train starts, the elastically expandable bodies 28 are placed under pressure so as to expand, wherein a water pressure is then generated in central cavity 29, wherein this pressure has a value greater than or equal to the pressure generated in the elastically expandable bodies 28. The underside of each of the elastically expandable bodies 28 is hereby pressed onto track 7, while from central cavity 29 a thin water film is urged beneath the elastically expandable bodies 28. A thin film of water from central cavity 29 hereby reaches the outside of pressure collar 27, so that bogie 6 with sole 10 thereon with pressure collar 27 is raised under pressure collar 27 and a thin water film is provided for the sliders 24 shown in FIG. 1 and further described hereinbelow with reference to FIG. 5. From stationary position a pressure of for instance 8 bar is herein generated in the elastically expandable bodies 28 and an at least slightly higher pressure, for instance 8.1 bar, is generated in the central cavity 29 so that the water will spread in all directions relative to central cavity 29. At pressures such as mentioned above, each bogie as according to FIGS. 2 and 3 is capable of carrying a weight of ±20 tons. Since an average carriage has a weight of about 80 tons, four bogies per carriage are sufficient to lift this one carriage.

The elastically expandable bodies 28 otherwise have the advantage that the underside of the bogie optimally adapts at all times to irregularities possibly present in the surface of track 7.

By adapting the pressure in the elastically expandable bodies 28, in central cavity 29 and the space under the bogie where gas hose 17 and water hoses 18 debouch, it is possible to influence the behaviour of the bogie in respect of the water film generated therewith as well as the tilting behaviour and the tilting position of the bogie. In this manner a very readily applicable solution is therefore provided, inter alia as a result of the small water losses, which results in an efficiently operating train.

Figure 4:
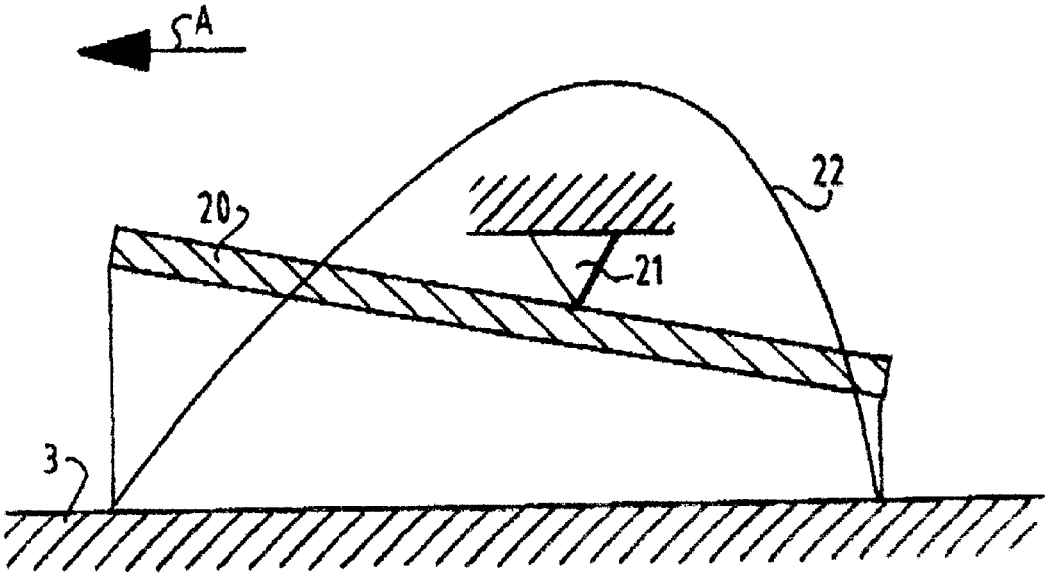
FIG. 4 is a schematic view of the principle of operation of the invention.

FIG. 4 shows the operating principle of a bogie or, more particularly, of a slider 24 as shown in FIG. 1 which will be further described hereinbelow with reference to FIG. 5, in a train according to the present invention. Sole 10 or sliding surface 33 is shown herein as a plate 20 and the shaft is shown as the component 21 designed as tilting point.

In this figure a curve is also plotted indicating the upward pressure on the underside of the sole or the sliding surface exerted by the water film. This curve is designated with 22.

The tilting point 21 is placed eccentrically relative to sole 20 or sliding surface 33, i.e. tilting point 21 is situated behind the centre of the length of plate 20, as viewed in the direction of locomotion of the train designated with arrow A.

Curve 22 shows that the upward pressure exerted on the underside of plate 20 increases in rearward direction at a determined speed as a result of the inclining position of plate 20 until it reaches a maximum close to the rear of the plate, and then decreases to zero over a short distance along plate 20. This decrease from the maximum to zero over the rear part of plate 20 can be attributed to a suction action close to the rear end of the plate 20 on the liquid, more particularly the water, thereunder.

The inclining position of plate 20 ensures that all the water or optionally other liquid arranged on the track is enclosed beneath plate 20. Plate 20 subsequently moves thereover, wherein the sloping position thereof inclining upward at the front is maintained. This latter is a result of the fact that the moment generated in front of tilting point 21 in the direction of movement is in equilibrium with the moment generated behind tilting point 21 in the direction of movement.

When plate 20 moves over the water film, the water film is compressed thereunder in the rearward direction of the sole, which results in the maximum in curve 22.

At a change in the speed of the train, a shift of the maximum in curve 22 would be caused in the case of a fixed position of the sole or sliding surface. However, in the embodiment shown here, the sole is mounted for tilting in the bogie at the tilting point 21. As a result hereof, under the influence of the tendency of the maximum to shift at a variation in the speed of the train, it is the position of sole 20 or sliding surface 33 which will change in order to prevent a shift of the maximum in curve 22 and a change in the equilibrium. Plate 20 is therefore self-adjusting in respect of the pressure on the sole and/or the speed of the train in the direction of the arrow A.

FIG. 5 shows a perspective view of a slider 24 as applied in the train shown in FIG. 1. FIG. 6 further shows a detail of slider 24 shown in FIG. 5. Slider 24 is connected to the train in the same manner as bogie 6 in FIG. 2 and is therefore also self-adjusting in respect of the speed of the train in the direction of the arrow A which is also shown here, as described with reference to FIG. 4. Said connection is here also such that slider 24 is tiltable in the direction parallel to the direction of movement of arrow A and the direction transversely hereof, so that slider 24 can be placed in any random tilting position relative to the horizontal within pre-determined ranges, which takes place mainly under the influence of the upward pressure exerted thereon by the liquid over which slider 24 moves.

As is shown most clearly in FIG. 6, sliding surface 33 of slider 34 is provided on the underside with profiled grooves which have a converging form in a direction opposed to the direction of movement of arrow A. The grooves are designated with reference numeral 34. This brings about an improved containment of the water film lying on track 7 under sliding surface 33 at the front in the direction of movement of arrow A, thus preventing a part of this water film on track 7 being scraped off by the front edge of sliding surface 33. This would result in a reduction of the aquaplaning effect, which is therefore effectively prevented.

The water enclosed in the wide part 35 of grooves 34 is compressed in rearward direction, when slider 24 moves thereover, as a result of the convergence of grooves 34. Owing to this compressing action of grooves 34 the water is also driven out of these grooves 34 in downward direction, thus bringing about an improvement in the pressure of the water film over track 7 in upward direction on slider 24.

The depiction of the grooves in FIGS. 5 and 6 is slightly exaggerated. In a practical embodiment they are markedly smaller but are shown here enlarged for the sake of clarity. The form of the grooves in an embodiment not shown here is also such that the depth thereof decreases to zero in rearward direction relative to the direction of locomotion of the train. In another embodiment (not shown) the form of the grooves is not parallel to the direction of locomotion but herringbone-shaped, wherein the grooves run in rearward direction from the sides of the slider to the middle of the slider and herein may or may not decrease in depth to zero.

Particularly when use is made of the scraping device(s) such as described with reference to FIG. 1, the groove patterns under the sliders can possibly by dispensed with, since with the scraping device(s) a distribution of the water film over desired parts of the surface of track 7 can be achieved to allow each of the sliders to function.

In an embodiment (not shown) use is made instead of these grooves of for instance a chamfering of the leading edge of the sliding surface in order to prevent a part of the water film being scraped off hereby. Many other embodiments are further possible within the scope of the invention as defined in the appended claims, such as a triangular shape or the shape of a semi-ellipse for the bogie or the slider, a different choice of material for the track, as long as this material can be applied in hard and flat manner, chamferings on the sliders etc., so that the scope of protection of the appended claims should not be interpreted as being limited to the above described embodiments.

What is claimed is:

1. Train which forms a transport device displaceable along a fixed track, comprising:

a frame with a drive;

at least one bogie with a flat sole; and at least one supply of a liquid which is suitable for pouring the liquid over the track, wherein a speed of the train higher than a threshold value at least a part of the sole floats over a film created by the liquid, characterized in that the supply is adapted to carry the liquid onto the track in front of the sole in a direction of movement of the train, and that the sole is positioned inclining upward on a front side in the direction of movement.

2. Train as claimed in claim 1, characterized in that the bogie is arranged for free tilting on the train at least in the direction of movement thereof, wherein a tilting point of the bogie is positioned in the direction of movement behind a center of the length of the sole and in front of a maximum the upward pressure on the bogie generated at the higher speed by the liquid film.

3. Train as claimed in claim 1, characterized in that the sole forms a sliding surface.

4. Train as claimed in claim 3, characterized in that the sliding surface contains grooves lying in a direction of locomotion of the train.

5. Train as claimed in claim 4, characterized in that the grooves are designed narrowing in rearward direction relative to the direction of locomotion.

6. Train as claimed in claim 1, characterized in that at least one supplementary supply of additional liquid is arranged in the bogie and debouches under the sole.

7. Train as claimed in claim 6, characterized in that at least one conduit is arranged in the bogie which debouches under the sole for supply of a fluid with a lower viscosity than the liquid.

8. Train as claimed in claim 6, characterized in that the sole is divided into at least two areas which are enclosed by downward extending peripheries of resilient material substantially along the circumference of each of the areas.

* * * * *